US008823262B2

(12) United States Patent
Wei et al.

(10) Patent No.: US 8,823,262 B2
(45) Date of Patent: Sep. 2, 2014

(54) HELICAL SLOW-WAVE STRUCTURE INCLUDING A HELIX OF RECTAGULAR CROSS-SECTION HAVING GROOVES THEREIN ADAPTED TO RECEIVE SUPPORTING RODS THEREIN

(75) Inventors: Yanyu Wei, Chengdu (CN); Luwei Liu, Chengdu (CN); Yubin Gong, Chengdu (CN); Xiong Xu, Chengdu (CN); Hairong Yin, Chengdu (CN); Lingna Yue, Chengdu (CN); Yang Liu, Chengdu (CN); Jin Xu, Chengdu (CN); Wenxiang Wang, Chengdu (CN)

(73) Assignee: University of Electronic Science and Technology of China, Chengdu, Sichuan (CN)

( * ) Notice: Subject to any disclaimer, the term of this patent is extended or adjusted under 35 U.S.C. 154(b) by 342 days.

(21) Appl. No.: 13/345,121

(22) Filed: Jan. 6, 2012

(65) Prior Publication Data

US 2012/0119646 A1 May 17, 2012

(51) Int. Cl.
*H01J 23/26* (2006.01)
*H01J 25/34* (2006.01)

(52) U.S. Cl.
CPC *H01J 23/26* (2013.01); *H01J 25/34* (2013.01)
USPC ..... 315/3.5

(58) Field of Classification Search
CPC ..... H01J 23/24; H01J 23/26; H01J 23/27; H01J 25/34
USPC ..... 315/3.5
See application file for complete search history.

(56) References Cited

U.S. PATENT DOCUMENTS

| | | | | |
|---|---|---|---|---|
| 2,444,206 | A * | 6/1948 | Pease | 333/244 |
| 3,735,188 | A * | 5/1973 | Anderson et al. | 315/3.5 |
| 4,153,859 | A | 5/1979 | Gross | |
| 4,645,117 | A | 2/1987 | Knapp et al. | |
| 5,112,438 | A * | 5/1992 | Bowers | 216/48 |
| 5,495,144 | A | 2/1996 | Nishida | |
| 6,917,162 | B2 | 7/2005 | Dayton, Jr. | |

* cited by examiner

*Primary Examiner* — Benny Lee
(74) *Attorney, Agent, or Firm* — Vedder Price P.C.; Thomas J. Kowalski; Rebecca G. Rudich

(57) ABSTRACT

The present invention provides a helical slow-wave structure, including a helix, a metal barrel and several supporting rods. The plurality of supporting rods may be inserted into the lines of the grooves tightly, this increases the contact area between the helix and the plurality of supporting rods. With a proper assembly method, the thermal contact resistance between helix and supporting rod may be decreased. So, the invention may enhance the capability of transferring the heat out of the helical slow-wave structure. The helix may have higher heat capacity, therefore, the helical slow-wave structure may become more firm, and more reliable.

4 Claims, 3 Drawing Sheets

HELICAL SLOW-WAVE STRUCTURE INCLUDING A HELIX OF RECTAGULAR CROSS-SECTION HAVING GROOVES THEREIN ADAPTED TO RECEIVE SUPPORTING RODS THEREIN

INCORPORATION BY REFERENCE

All documents cited or referenced herein ("herein cited documents"), and all documents cited or referenced those cited documents, together with any manufacturer's instructions, descriptions, product specifications, and product sheets for any products mentioned herein or in any document incorporated by reference herein, are hereby incorporated herein by reference, and may be employed in the practice of the invention. More specifically, all referenced documents are incorporated by reference to the same extent as if each individual document was specifically and individually indicated to be incorporated by reference.

FIELD OF THE INVENTION

The present invention relates to the field of microwave device, more particularly to a slow-wave structure used in traveling wave amplifiers or oscillators. It also can be used in other devices that employ slow-wave structure.

BACKGROUND OF THE INVENTION

In a traveling wave amplifier or oscillator, a stream of electrons interact on a propagating electromagnetic wave, causing the electromagnetic wave to be amplified. In order to achieve the desired interaction, the electromagnetic wave is propagated along a slow-wave structure, such as helical slow-wave structure. The slow-wave structure provides a path of propagation for the electromagnetic wave, and the path is longer than the axial length of the structure so that the electromagnetic wave can propagate axially at the velocity of the electron stream.

The helical slow-wave structure is a critical component in the traveling wave amplifiers or oscillators, and its helix is supported within an encasing barrel by means of a plurality of electrically insulating rods, which are positioned equally, circumferentially around the helix. In a high power traveling wave amplifier or oscillator, electron beam interaction and RF losses can produce a lot of heat, leading to high operating temperature.

For traveling wave amplifiers or oscillators working at small and medium power, the slow-wave structure is assembled by cold stuffing/fitting technology or hot insertion method. A conventional helical slow-wave structure is shown in FIG. 1 and FIG. 2. The helix 3 is made of tungsten or molybdenum, the supporting rods 2 are made of beryllia or boron nitride, and the encasing barrel 1 is made of stainless steel. Using conventional assembly, the contact area between helix 3 and supporting rods 2 is a line before assembling and only a narrow side after assembling, far smaller than the width d of supporting rods 2 as shown in FIG. 2. The thermal contact resistance between helix 3 and supporting rods 2 is very large, thus the helical slow-wave structure in prior art has bad heat dissipation capability.

In order to enhance heat dissipation capability and thereby increase output power of the helical traveling wave amplifiers or oscillators, the helix 3 is brazed to the dielectric supporting rods 2 that are brazed to encasing barrel 1. This method can increase the contact area and decrease thermal contact resistance between various components of the helical slow-wave structure, but the process of assembly is very complex, and the accumulation of the solder can cause strong reflection of the electromagnetic wave, even induce oscillation in the traveling wave amplifiers or oscillators.

In order to overcome the deficiencies cited above, diamond is used as the material of the supporting rods 2 in the slow-wave structure, which is reported in U.S. Pat. No. 6,917,162 B2. Although diamond has high thermal conductivity, the process of assembly is also very complex and the cost of diamond is very expensive, so it is not widely used.

Citation or identification of any document in this application is not an admission that such document is available as prior art to the present invention.

SUMMARY OF THE INVENTION

The present invention provides a helical slow-wave structure that overcomes the problems and deficiencies of the priority art. Thus, in accordance with the present invention, a helical slow-wave structure is provided which may comprise a helix, a metal barrel and a plurality of electrically insulated supporting rods; The helix may be wound around a central axis at a certain radius therefrom, and supported within the metal barrel by means of the plurality of supporting rods, which may be positioned equally, circumferentially around the helix.

The helix may be an electrically conductive component with rectangular cross-section. A large number of grooves may be made in the outside surface of the helix. The depth of each groove may be less than the thickness of the helix, wherein the thickness of the helix is the length between inside and outside surface of the rectangular cross-section, i.e., the length between an inside surface and an outside surface of the helix. The shape of each supporting rod may be made according to shape of the corresponding groove, and the plurality of supporting rods may be inserted into the grooves tightly.

In an embodiment of the helical slow-wave structure, a large number of grooves may be divided into several pluralities of grooves, each plurality of the grooves may be lined in parallel with the central axis of the helix, and each supporting rod may be inserted into a corresponding ones of the plurality of the grooves.

The shape of groove may be rectangular, trapezoidal or a sector.

The objectives of the present invention may be realized as follows:

The plurality of supporting rods may be inserted into the lines of the grooves tightly, this increases the contact area between the helix and the plurality of supporting rods. With proper assembly method, the thermal contact resistance between the helix and the supporting rod may be decreased. So, the invention may enhance the capability of transferring the heat out of the helical slow-wave structure. The helix may have higher heat capacity, therefore, the helical slow-wave structure may become more firm, and more reliable.

Accordingly, it is an object of the invention to not encompass within the invention any previously known product, process of making the product, or method of using the product such that Applicants reserve the right and hereby disclose a disclaimer of any previously known product, process, or method. It is further noted that the invention does not intend to encompass within the scope of the invention any product, process, or making of the product or method of using the product, which does not meet the written description and enablement requirements of the USPTO (35 U.S.C. §112, first paragraph) or the EPO (Article 83 of the EPC), such that Applicants reserve the right and hereby disclose a disclaimer of any previously described product, process of making the product, or method of using the product.

It is noted that in this disclosure and particularly in the claims and/or paragraphs, terms such as "comprises", "comprised", "comprising" and the like can have the meaning attributed to it in U.S. patent law; e.g., they can mean "includes", "included", "including", and the like; and that terms such as "consisting essentially of" and "consists essentially of" have the meaning ascribed to them in U.S. patent law, e.g., they allow for elements not explicitly recited, but exclude elements that are found in the prior art or that affect a basic or novel characteristic of the invention.

These and other embodiments are disclosed or are obvious from and encompassed by, the following Detailed Description.

BRIEF DESCRIPTION OF THE DRAWINGS

The following detailed description, given by way of example, but not intended to limit the invention solely to the specific embodiments described, may best be understood in conjunction with the accompanying drawings.

DETAILED DESCRIPTION OF THE PREFERRED EMBODIMENT

Figure 1:
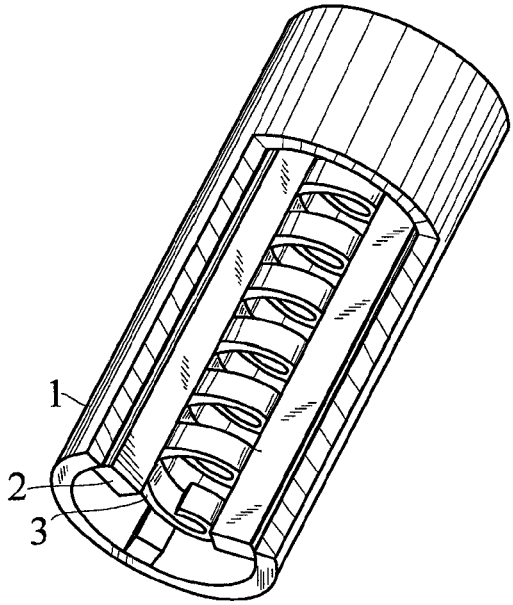
Fig. 1 PRIOR ART
FIG. 1 is a perspective view of a helical slow-wave structure in prior art.
Figure 2:
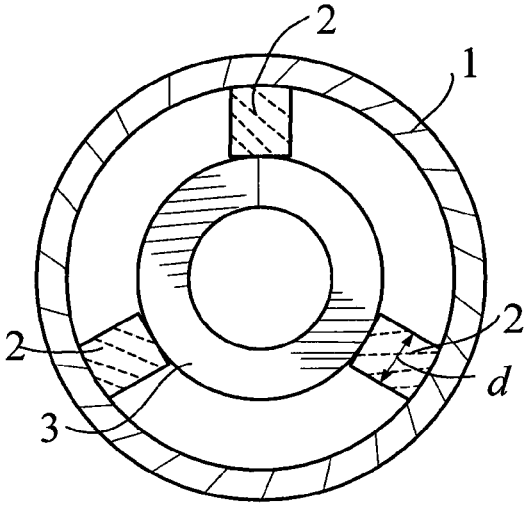
Fig. 2 PRIOR ART
FIG. 2 is a cross-sectional view of the prior art helical slow-wave structure shown in FIG. 1.

Hereinafter, preferred embodiments of the present invention will be described with reference to the accompanying drawings. It should be noted that the similar features are designated by similar reference numerals although they are illustrated in different drawings. Also, in the following description, a detailed description of known functions and configurations incorporated herein will be omitted when it may obscure the subject matter of the present invention.

Figure 3:
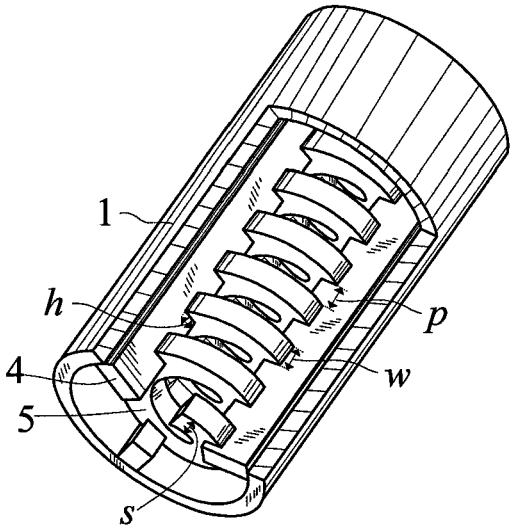
FIG. 3 is a perspective view of a helical slow-wave structure according to one embodiment of the present invention.
Figure 4:
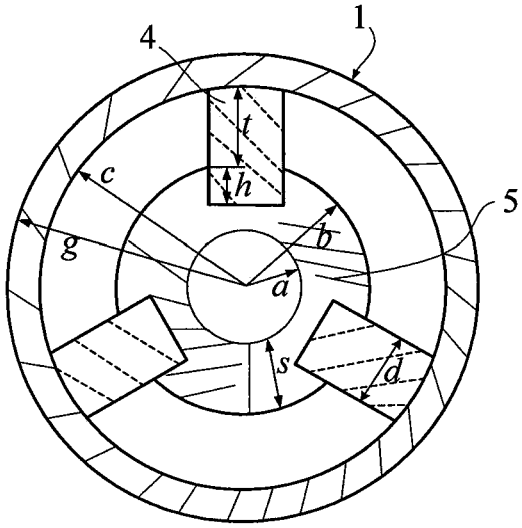
FIG. 4 is a cross-sectional view of the helical slow-wave structure shown in FIG. 3.
Figure 5:
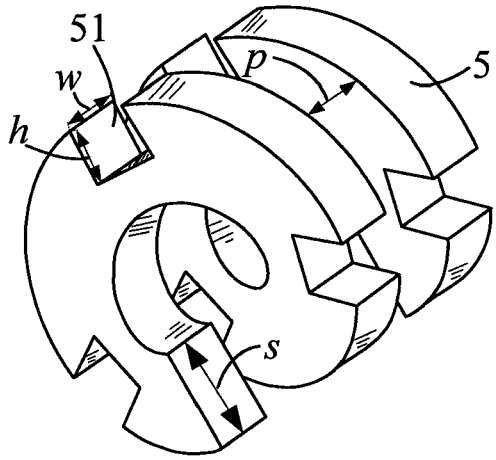
FIG. 5 is a perspective view of the helix shown in FIG. 3.

In one embodiment, as shown in FIG. 3 to FIG. 5, the helical slow-wave structure comprises a helix 5, a metal barrel 1 (FIGS. 3 and 4) and a plurality of electrically insulated supporting rods 4 (FIGS. 3 and 4). The helix 5 is wound around at a certain radius, and supported within the metal barrel 1 by means of the plurality of the supporting rods 4, which are positioned equally, circumferentially around the helix 5.

A large number of grooves 51 (FIG. 5) are made in the outside surface of the helix 5, the depth h of the groove is less than the thickness s of the helix 5.

The large number of grooves 51 are divided into three pluralities, and each plurality of grooves 51 are lined in parallel with the central axis of the helix 5, the shape of the supporting rods 4 are made according to the shape of the grooves 51, and the plurality of the supporting rods 4 are inserted into the lines of the grooves 51 tightly.

The shape of the grooves 51 is rectangular, trapezoidal or sectorial.

The helix 5 is made of molybdenum, the metal barrel 1 is made of stainless steel, and the supporting rods 4 is made of beryllia with a relative dielectric constant of 6.5. In the embodiment, the size parameters of the helical slow-wave structure are defined as follows: a (FIG. 4) is inner radius of the helix 5; b (FIG. 4) is outer radius of the helix 5; s (FIGS. 4 and 5) is the thickness of helix 5; c (FIG. 4) is inner radius of the metal barrel 1; g (FIG. 4) is outer radius of the metal barrel 1; d (FIG. 4) is the width of supporting rods 4; h (FIGS. 4 and 5) is the depth of grooves 51; t (FIG. 4) is the distance between outer radius of the helix 5 and inner radius of the metal barrel 1; w (FIGS. 3 and 5) is the width of helix 5; p (FIGS. 3 and 5) is the pitch of helix 5.

Figure 6:
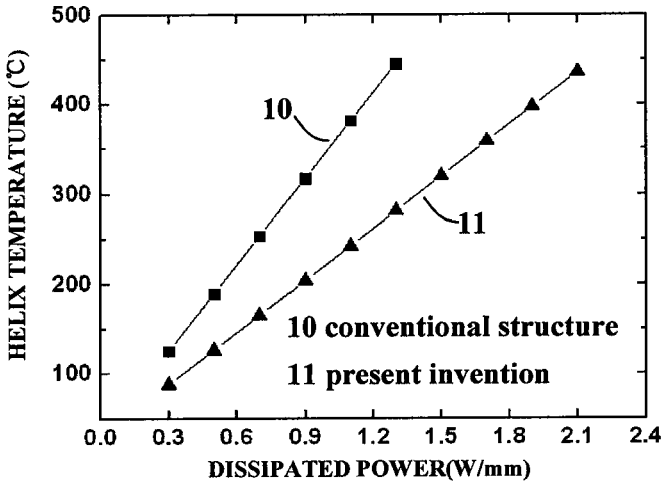
FIG. 6 is the heat dissipation comparison view between one embodiment of the present invention and a conventional helical slow-wave structure.

A helical slow-wave structure according to one embodiment of the present invention has been tested in a traveling wave tube with a center operating frequency of 30 GHz. The detailed size parameters are set as follows: a=0.35 mm; b=0.75 mm; s=0.4 mm; c=1.15 mm; g=1.45 mm; d=0.3 mm; h=0.15 mm; t=0.4 mm; w=0.4 mm; p=0.8 mm. The contact heat resistance between the helix 5 and the supporting rods 4, as well as the supporting rods 4 and the metal barrel 1 is set as 81° C.·mm$^2$/W. Ambient temperature is set as 30° C. Thereafter, the Finite Element Method software developed by ANSYS, Inc. was used to analyze the thermal distribution of the helical slow-wave structure. The relationship between the highest temperature and dissipation power per unit length of the invention structure and the conventional helical slow-wave structure is obtained, the results is shown in FIG. 6. The hottest part of the helical slow-wave structure is the helix. The vertical axis parameter "Helix Temperature (° C.)" shown in FIG. 6 is the highest temperature of the helical slow-wave structure.

It can be seen from the curves 10 and 11 in the FIG. 6, the present invention (i.e., curve 11) has lower working temperature than that of the conventional helical slow-wave structure (i.e., curve 10), when dissipating the same power in the unit length (i.e., W/mm) of the slow-wave structure. For example, when the dissipation power is 1.3 W, the highest temperature in the conventional structure is 445.07° C., while the highest temperature in the present invention is 281.29° C., they differ 163.78° C. According to a large number of experiment results, when the helix temperature exceeds 400° C., the reliability and the life of traveling wave amplifiers or oscillator will be decreased. Therefore, the present invention has better heat dissipation capacity and stronger electron colliding than the conventional structure.

When the helix achieves the same temperature, the structure of the present invention can dissipate more power than the conventional structure, such as when the helix temperature is 350° C., the structure according to the present invention can withstand power of about 1.68 W, while the conventional structure can only withstand power of about 1 W. It shows that the invention has higher thermal capacity. Hence, the present invention can improve the reliability to traveling wave amplifiers or oscillators.

Having thus described in detail preferred embodiments of the present invention, it is to be understood that the invention defined by the above paragraphs is not to be limited to particular details set forth in the above description as many apparent variations thereof are possible without departing from the spirit or scope of the present invention.

What is claimed is:

1. A helical slow-wave structure comprising: a helix, a metal barrel and a plurality of electrically insulated supporting rods; the helix is wound around a central axis at a certain radius therefrom, and supported within the metal barrel by means of the plurality of supporting rods, which are positioned equally, circumferentially around the helix;

wherein the helix is an electrically conductive structure and has a rectangular cross-section, the rectangular cross-section having an inside surface and an outside surface, and a large number of grooves are made in the outside surface of the helix, the depth of each groove is less than the thickness of the helix, the thickness of the helix is the length between the inside surface and the outside surface of the rectangular cross-section.

2. A helical slow-wave structure of claim 1, wherein the shape of each supporting rod is made according to shape of the corresponding groove, and the plurality of supporting rods are inserted into the grooves tightly.

3. A helical slow-wave structure of claim 2, wherein the large number of grooves are divided into several pluralities of grooves, and each plurality of the grooves are lined in parallel with the central axis of the helix, each supporting rod is inserted into corresponding ones of the plurality of the grooves.

4. A helical slow-wave structure of claim 2, wherein the shape of groove is rectangular or trapezoidal.

* * * * *